US005131454A

United States Patent [19]

Camp

[11] Patent Number: 5,131,454

[45] Date of Patent: Jul. 21, 1992

[54] METHOD AND APPARATUS FOR SEPARATING DIFFERENT GRADES OF STEEL IN CONTINUOUS CASTING SYSTEMS

[75] Inventor: Steven Camp, Addison, Ill.

[73] Assignee: Better Bilt Products, Inc., Addison, Ill.

[21] Appl. No.: 655,792

[22] Filed: Feb. 14, 1991

[51] Int. Cl.[5] ..... B22D 11/00

[52] U.S. Cl. ..... 164/459; 164/418

[58] Field of Search ..... 164/418, 459, 461, 419

[56] References Cited

U.S. PATENT DOCUMENTS 4,250,945 2/1981 Koshikawa et al. ..... 164/461

FOREIGN PATENT DOCUMENTS 58-138543 8/1983 Japan ..... 164/459

*Primary Examiner*—Kuang Y. Lin

*Attorney, Agent, or Firm*—Leydig, Voit & Mayer

[57] ABSTRACT

A continuous steel casting system having a mold into which molten steel of different grades may be successively introduced and from which a casting continuously emerges. A grade separator device is provided that is positionable into the mold inlet opening immediately following completion of the introduction of a first grade of molten steel and before the introduction of a second grade for forming a separating barrier between the first and second grades of molten steel and for enhancing cooling and solidification at the juncture between the first and second grades of molten steel. The grade separator device comprises a plurality of elongated spaced apart steel separator plates arranged in a V configuration that permits limited flow through of the second grade of molten steel about the grade separator device and into limited intermixing relation with the first grade of molten steel for preventing the entrapment of gas bubbles about the separator device and for reducing the tendency of splattering of the second grade of molten metal when directed into the mold and onto the grade separator device.

22 Claims, 5 Drawing Sheets

METHOD AND APPARATUS FOR SEPARATING DIFFERENT GRADES OF STEEL IN CONTINUOUS CASTING SYSTEMS

FIELD OF THE INVENTION

The present invention relates generally to continuous steel casting, and more particularly to a method and apparatus for separating one grade of steel from a subsequently cast grade of steel in a continuing casting operation.

BACKGROUND OF THE INVENTION

In continuous casting of steel, it often is necessary to change the grade of steel for the particular job without interrupting the continuous operation of the system. To this end, when the supply of one grade of molten metal to the mold of the continuous casting machine is completed, it is customary to immediately begin supplying the mold with the next grade of steel so that the casting operation proceeds on a continuous and uninterrupted basis. While a thin skin quickly forms on the outside of the molten metal as it passes through the mold, the interior of the casting remains liquid for a period of time during the casting and subsequent cooling operation. When the beginning of a new grade of molten steel joins the trailing end of the previous different grade steel in the mold an intermixing of the two grades of steel occurs, which can affect a segment of the casting 20 to 30 feet in length, which must be scrapped and ultimately reprocessed as secondary steel at considerable expense.

While proposals have been made for introducing a physical separator between the runs of different grades of steel in continuous casting machines, such efforts have been subject to further problems. When a steel plate or the like barrier is positioned into the mold immediately upon completion of the introduction of one grade of steel and prior to the introduction of the next, splattering of molten metal can occur when the subsequently introduced molten metal strikes the separating plate, which can contaminate the surrounding environment and create a safety hazard to personnel handling the separator plate. Moreover, it is difficult to position the separator plate in the mold between the grades of molten steel without leaving cavities or bubbles of gas entrapped about the separating plate, which can cause explosions and again dangerous splattering of the molten metal. Finally, manual manipulation of such steel separator plates, which are relatively heavy, can be fatiguing to workers, particularly in the hot environment adjacent the entrance to the mold.

OBJECTS AND SUMMARY OF THE INVENTION

It is an object of the present invention to provide a grade separator method and apparatus adapted for minimizing costly waste and reprocessing of steel during grade changes in continuous steel casting operations.

Another object is to provide a method and apparatus for separating different grades of molten steel in continuous steel casting systems without dangerous and contaminating splattering of molten metal.

A further object is to provide a grade separator device for continuous steel casting systems which is adapted for safe and relatively easy handling and manipulation.

Other objects and advantages of the invention will become apparent upon reading the following detailed description and upon reference to the drawings, in which:

Figure 1:
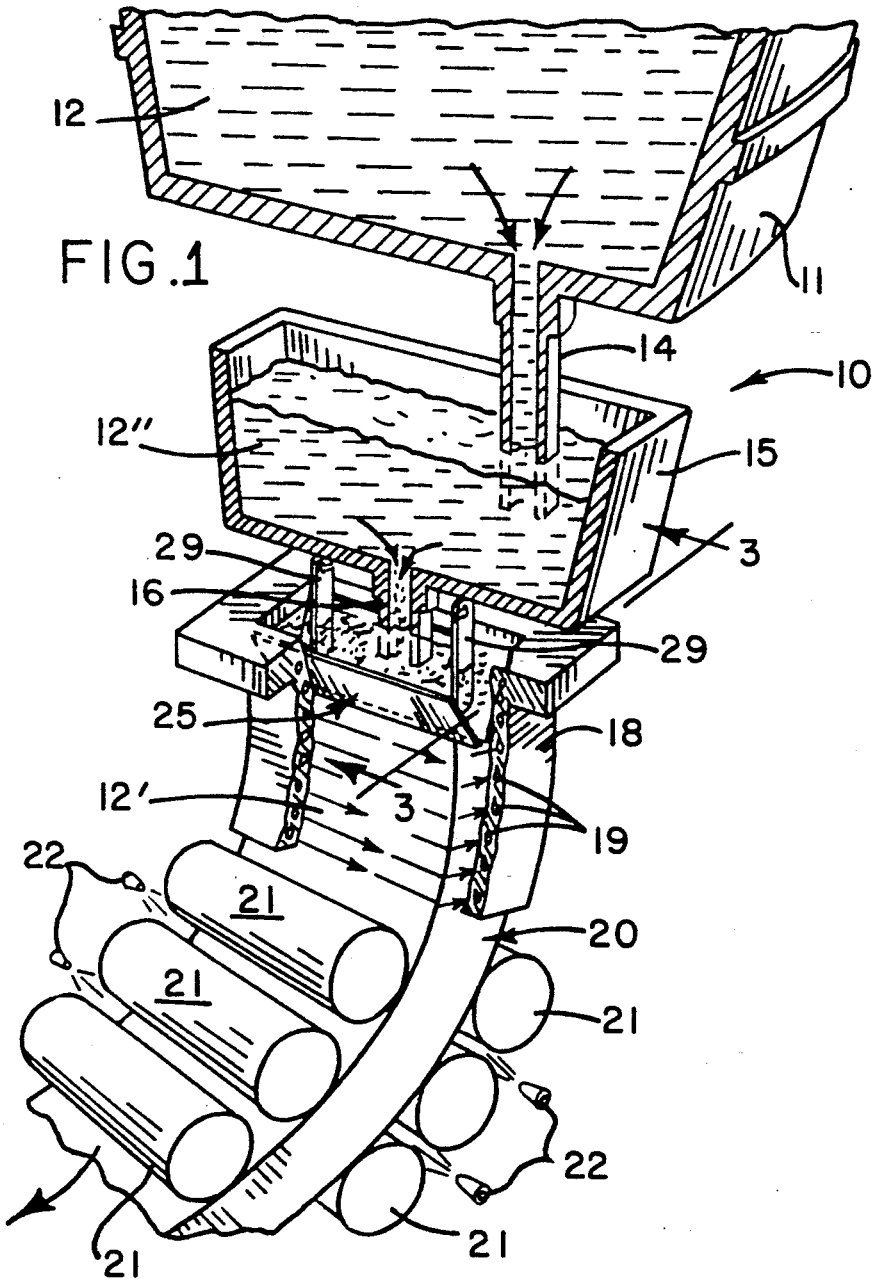
FIG. 1 is a partially diagrammatic illustration of a continuous steel casting system depicting the use of the method and apparatus of the present invention.

While the invention is susceptible of various modifications and alternative constructions, certain illustrated embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention.

DETAILED DESCRIPTION OF THE PREFERRED EMBODIMENTS

Referring now more particularly to FIG. 1 of the drawings, there is shown an illustrative continuous steel casting system 10 depicting the use of the grade separating method and apparatus of the present invention. The casting system 10, which may be of a conventional type, includes a ladle 11 for containing a supply of molten steel 12 to be cast. The ladle has a shroud 14 for feeding a tundish 15 located therebelow, which in turn has a slide gate 16 for supplying the molten metal 12 to a mold 18 of the continuous casting system in controlled fashion. The mold 18 typically if formed of copper and has internal water cooling lines 19 for causing a thin skin to solidify on the outside of the casting 20 as it passes through the mold 18. By the time the casting 20 leaves the lower discharge end of the mold 18, the skin has hardened to a thickness of between $\frac{1}{4}$ and $\frac{3}{4}$ of an inch. The steel casting 20 continues to solidify as it is directed onto runout rollers 21 and is sprayed with cooling water from nozzles 22 disposed between the rollers 21. The casting 20 is directed in a large radius curve and ultimately onto a horizontal runout table where the cast slab is cut into predetermined sized lengths for subsequent processing.

Upon completion of casting of a particular grade of steel, as is known in the art, a ladle 11 containing a different grade of steel may be brought into position for supplying the tundish 15 and mold 18 without substantial interruption in the casting operation. As previously indicated, upon introduction of the new grade of steel into the mold during such a grade change procedure, mixing of the two different grades of molten steel will occur, which heretofore results in contamination of a segment of the casting 20 to 30 feet in length, which must be scrapped and subsequently reprocessed as secondary steel at significant cost.

In accordance with the invention, a discontinuous grade separator is physically positionable into the mold between the two grades of molten metal during a grade change operation in order to form a physical dam between the two grades of molten steel and create a cooling effect for enhancing solidification of the molten metal at the juncture between the different grades, while at the same time permitting limited flow through and intermixing of the two grades in order to prevent the entrapment of gas and dangerous splattering of the molten metal. To this end, a grade separator device 25 is provided which comprises a pair of flat steel separator plates 26 disposed in a generally V-shaped configuration with a downstream end thereof separated by a relatively small gap 28 so as to provide an opening therebetween. The plates 26 have a length "l ", corresponding substantially to the length of the opening in the mold and the device 25 has an overall width "w" corresponding substantially to the width of the mold opening. For supporting the separator plates 26, a pair of upstanding laterally spaced support plates 29 are provided, each having a generally V-configured lower end 30 welded to respective sides of the separator plates 26. The downstream ends of the separator plates 26 additionally are secured together by a plurality of laterally spaced welds 31. In the illustrated embodiment, the angle between the plates is on the order of 60° and the spacing of the apex of the plates is about ¼ of an inch. Although the angle of the separator plates 26 may vary, preferably the plates should define an angle between about 45° and 60°.

To facilitate handling of the grade separator device 25, the upstanding support plates 29 each are formed with a rod receiving groove or slot 34 adjacent an upper end thereof. In this instance, the rod receiving groove 34 of one plate 29 opens to one side of the plate and the rod receiving groove 34 of the other plate 29 opens in an opposite direction. The slots or grooves 39 permit the grade separator device 25 to be suspended from a support pole 35 held at opposite ends by workmen, as diagrammatically shown in FIG. 2, for positioning into the entry end of the mold 18. The oppositely directed slots 34 prevent inadvertent disengagement of the grade separator device 25 from the support pole 35 during handling. Alternatively, rod receiving grooves or slots 34 could be formed in upwardly inclined relation from a common side of the support plates 29.

Figure 2:
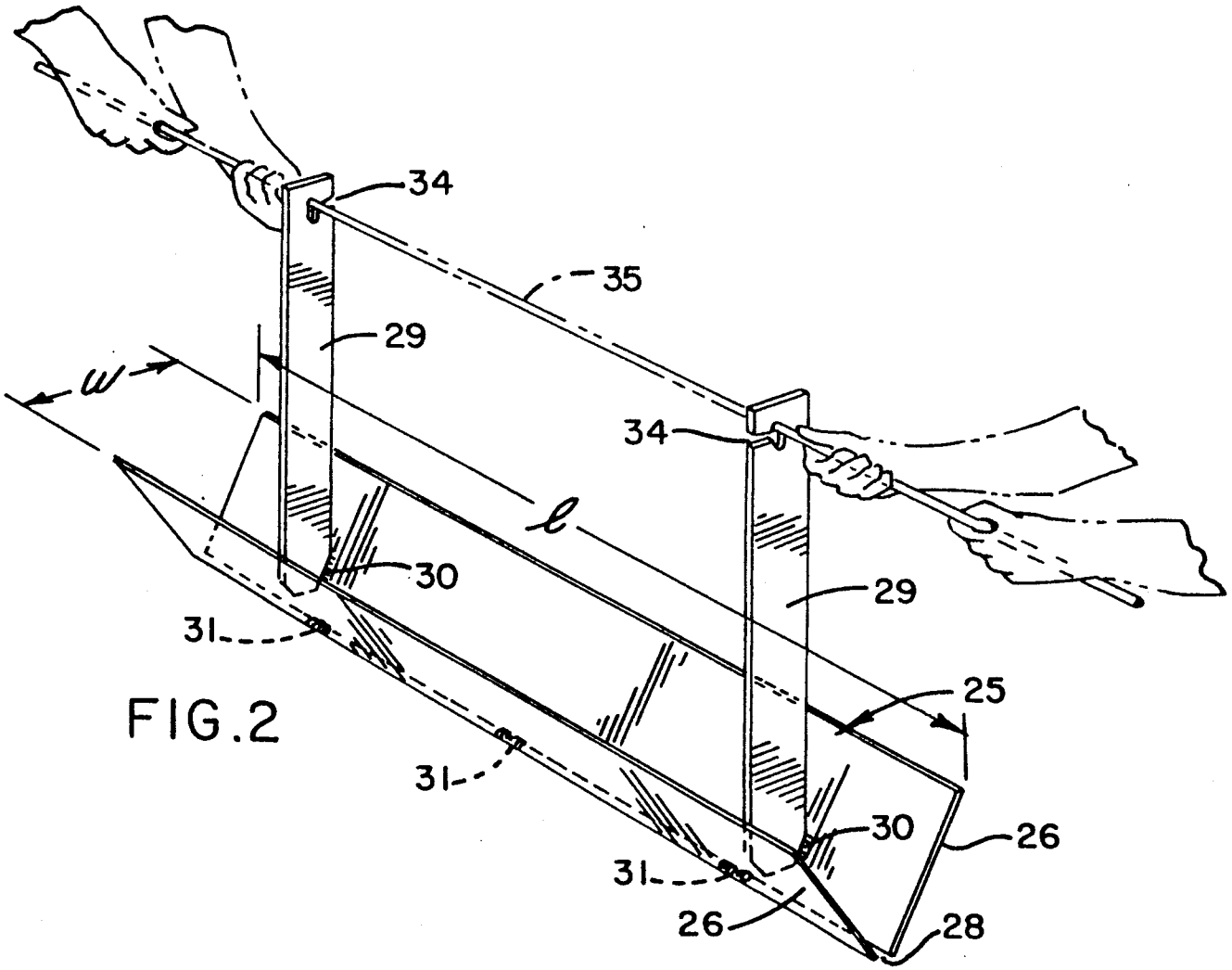
FIG. 2 is a perspective of the grade separator device of the present invention shown being handled by workmen prior to positioning into the mold of the continuous casting machine.
Figure 3:
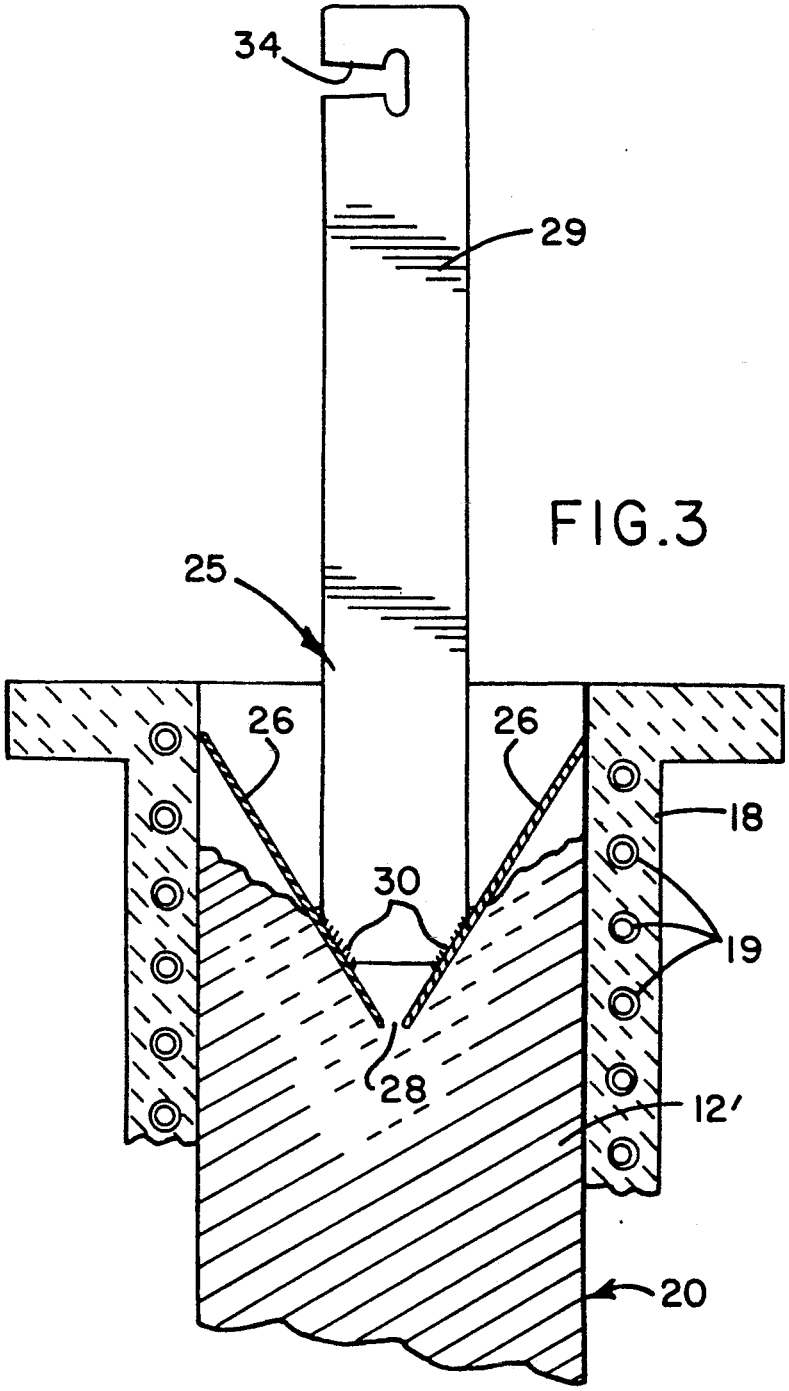
FIG. 3 is an enlarged vertical section, taken in the plane of 3—3 in FIG. 1, showing the grade separator device inserted into the mold of the continuous casting machine during a grade change.
Figure 4:
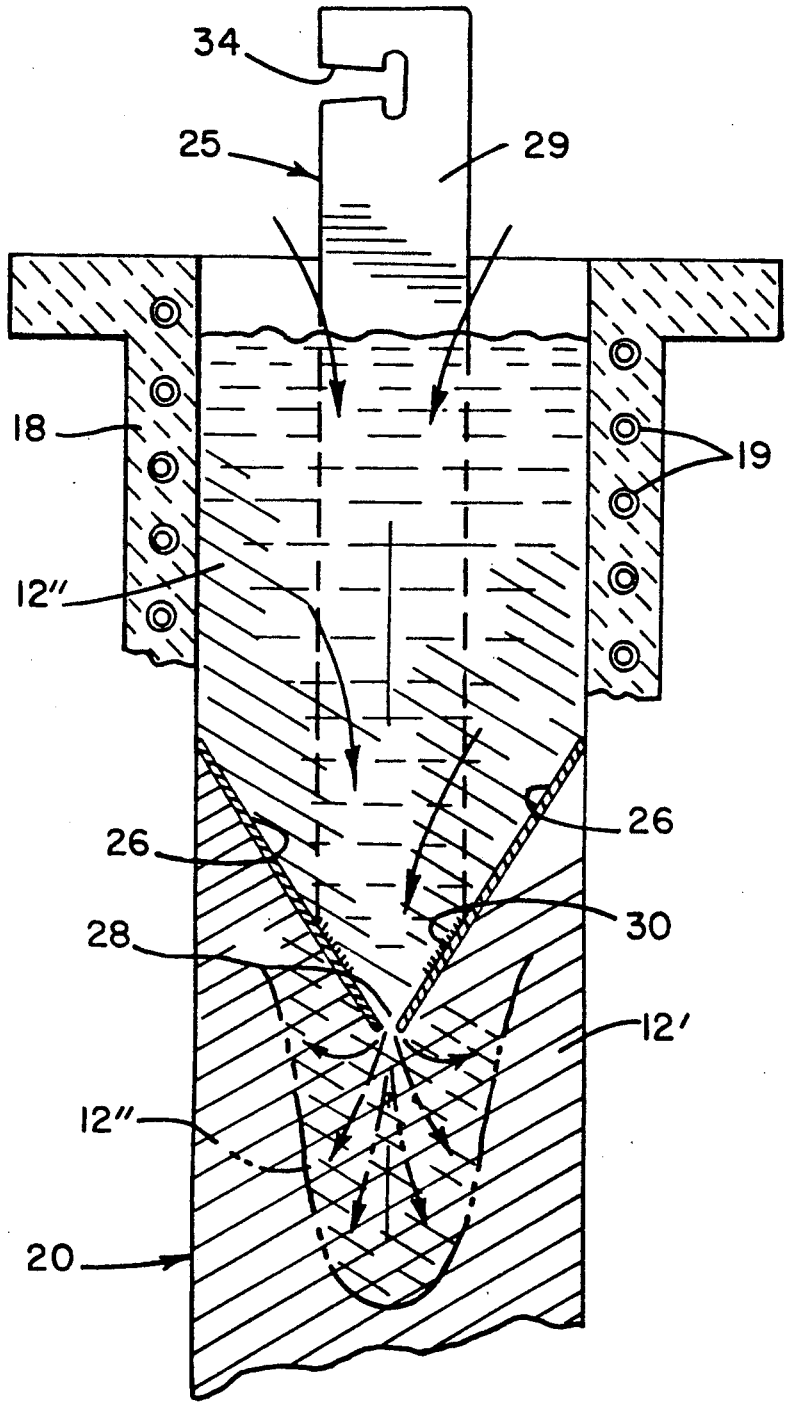
FIG. 4 is an enlarged vertical section, similar to FIG. 3, showing the effectiveness of the grade separator device following introduction of the next grade of steel into the mold.

In carrying out the invention, when a grade change is to occur in the continuous steel casting operation, following completion of a run with one grade 12' of molten steel and prior to start of the run with a different grade 12'', the grade separator device 25 is positioned into the entrance into the mold, as shown in FIGS. 1 and 3, by workmen holding the support pole 35, as shown in FIG. 2. The separator plates 26 of the device 25 are positioned into direct contact with the last of the previously introduced molten steel 12', with the support rods 29 extending vertically upwardly. Upon such positioning of the separator plates 26 into the mold 18, the support pole 35 may be disengaged from the slots 34 of the support plates 29. The next grade 12'' of molten steel may then be introduced the mold from the tundish 15 with the grade separator device 25 disposed between the two grades of steel and carried along with the continuously moving casting 20 (FIG. 4).

While the grade separator device 25 provides a significant dam between the grades 12', 12'' of steel, the discontinuous nature of the grade separator device 25, defined by the laterally spaced separator plates 26, enables sufficient molten metal to pass by the separator plates 26 so as to minimize splattering of the molten metal and the formation of air pockets which can create potentially explosive conditions endangering surrounding personnel. The V-shaped orientation of the separator plates 26 further tends to direct molten metal centrally into the mold. The grade separator device 25 has sufficient mass to enhance chilling and solidification of metal at the juncture between the two grades of molten metal so that intermixing thereof is limited to a relatively short length. In practice, it has been found that use of the grade separator device 25 limits intermixing of the different grades of steel to a length of about 20 to 30 inches, in contrast to 20 to 30 feet as is customary in conventional grade change procedures, so as to substantially reduce the amount of scrap and reprocessing that is necessary by reason of the grade change. In modern steel producing facilities, such reduction in scrap and reprocessing can result in more than millions of dollars a year in cost savings. It will be appreciated that the weight of the grade separator device also is lessened by virtue of its discontinuous plate design, enabling the personnel to more easily handle and manipulate the grade separator device in the high temperature environment of the casting machine without undue fatigue.

Figure 5:
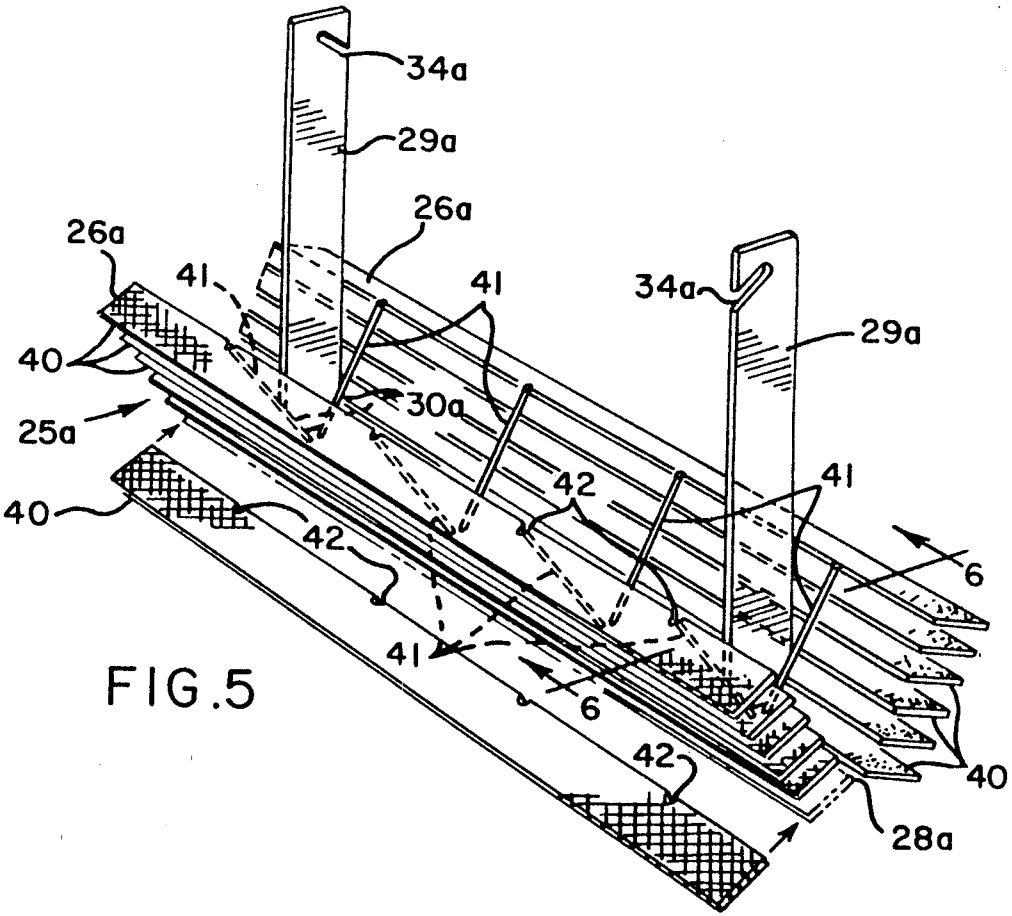
FIG. 5 is a perspective of an alternative embodiment of a grade separator device in accordance with the invention.
Figure 6:
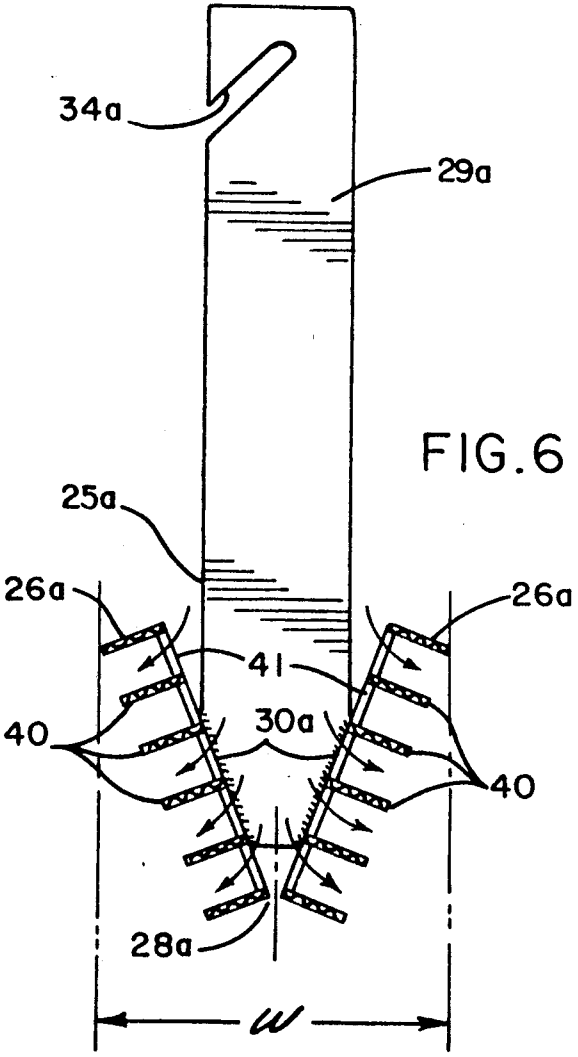
FIG. 6 is an enlarged vertical section of the grade separator device shown in FIG. 5, taken in the plane of line 6—6.

Referring now to FIGS. 5 and 6, there is shown an alternative embodiment of grade separator device **25*a* wherein items similar to those described above have been given similar reference numerals with the distinguishing suffix "a" added. The grade separator device 25*a* in this case again has a generally V-shaped configuration, but with each leg 26*a* of the V comprising a plurality of parallel spaced apart plates 40 which extend substantially the length of the mold opening with which it is to be used. For supporting the plates 40 of each leg 26*a* in a parallel array, a plurality of laterally spaced tie-rods 41 are welded to inner peripheral sides of each plate 40 in the array. The plates 40 in this case are formed with notches 42 within which the tie rods 41 are disposed. For supporting the array of plates 40 of each leg 26*a* in appropriate angular relation to each other, a pair of laterally spaced upstanding support plates 29*a*, each having a tapered or V-shaped lowermost end 30*a* are welded to respective tie-rods 41 and the immediately adjacent plates 40. The legs 26*a* in this case are carried by the support plates 29*a* so as to define an angle of about 60°, and the overall width "w" of the grade separator device 25*a*** again corresponds substantially to the width of the mold opening with which it is to be used for permitting free positioning of the grade separator device into the mold while forming a substantial barrier between two grades of molten metal introduced therein during a grade change.

It will be seen that upon placement of the grade separator device **25*a* into the mold 18 during a grade change operation immediately upon completion of the introduction of one grade of steel the spacing between the plates 40 of each leg will permit limited flow through and intermixing of the subsequently introduced grade of molten steel so as to prevent splashing and the formation of air pockets, which can create dangerous explosions and contamination of the surrounding area. At the same time, the legs 26***a* of the grade separator device 25*a* have sufficient mass as to enhance cooling and solidification of the two grades of steel in a relatively short distance, such as on the order of 20 to 30 inches, so as to minimize scrap and reprocessing.

From the foregoing, it can be seen that the method and apparatus of the present invention is adapted for effectively separating different grades of molten steel in continuous casting systems while minimizing costly waste and reprocessing. The grade separator device can be easily and safely used with lesser tendency for causing splattering of molten metal which can be dangerous to workmen and contaminating to the surrounding environment. Since the grade separator device employs a discontinuous array of metal plates, its weight is sufficiently reduced so as to facilitate relatively easy handling and manipulation by workers in the hot environment adjacent the mold.

What is claimed is:

1. In a continuous steel casting system comprising a mold having an inlet opening into which molten steel of different grades may be selectively directed and a discharge end from which at least a partially solidified casting continuously emerges, means for selectively directing successive different grades of steel into the mold, a grade separator device for positioning into the mold inlet opening immediately following completion of the introduction of a first grade of molten steel into the mold and before the introduction of a second grade for forming a separating barrier between the first and second grades of molten steel and for enhancing cooling and solidification at the juncture between said first and second grades of molten steel, and said grade separator device having a discontinuous V-shaped construction that permits limited flow through of the second grade molten steel through the grade separator device into intermixing relation to the first grade of molten steel for preventing the entrapment of gas bubbles about the separator device and for reducing the tendency of splattering of the second grade of molten steel when directed into the mold and onto the grade separator device.

2. In the continuous casting system of claim 1 in which said grade separator device comprises a plurality of spaced apart separator plates which extend substantially the length of the mold opening and which together span an overall width corresponding substantially to the width of the mold opening.

3. In the continuous casting system of claim 2 including a pair of support plates secured in upstanding relation to said separator plates for facilitating handling and positioning of said grade separator device into said mold.

4. In the continuous casting system of claim 3 in which said support plates each are formed with a slot for permitting transport and suspension of the grade separator device from a common support pole.

5. In the continuous casting system of claim 4 in which the slot of one support plate opens to one side of the separator plate and the slot in the other support plate opens in an opposite direction.

6. In a continuous steel casting system comprising a mold having an inlet opening into which molten steel of different grades may be selectively directed and a discharge end from which at least a partially solidified casting continuously emerges, means for selectively directing successive different grades of steel into the mold, a grade separator device for positioning into the mold inlet opening immediately following completion of the introduction of a first grade of molten steel into the mold and before the introduction of a second grade for forming a separating barrier between the first and second grades of molten steel and for enhancing cooling and solidification at the juncture between said first and second grades of molten steel, and said grade separator comprising two separator plates that are disposed in a V-shape with a spacing existing between a downstream apex end thereof and which extend substantially the length of the mold opening and together span an overall width corresponding substantially to the width of the mold opening so as to define a discontinuous construction that permits the limited flow of the second grade molten steel through the grade separator device into intermixing relation to the first grade of molten steel for preventing the entrapment of gas bubbles about the separator device and for reducing the tendency of splattering of the second grade of molten steel when directed into the mold and onto the grade separator device.

7. In the continuous casting system of claim 6 in which said separator plates define an angle of between about 45° and about 60°.

8. In the continuous casting system of claim 6 in which said separator plates define an angle of about 60°.

9. In a continuous steel casting system comprising a mold having an inlet opening into which molten steel of different grades may be selectively directed and a discharge end from which at least a partially solidified casting continuously emerges, means for selectively directing successive different grades of steel into the mold, a grade separator device for positioning into the mold inlet opening immediately following completion of the introduction of a first grade of molten steel into the mold and before the introduction of a second grade for forming a separating barrier between the first and second grades of molten steel and for enhancing cooling and solidification at the juncture between said first and second grades of molten steel, and said grade separator device having a generally V-shaped configuration with each leg of the V comprising a plurality of parallel spaced apart plates extending substantially the length of the mold opening so as to define a discontinuous construction that permits the limited flow of the second grade molten steel through the grade separator device into intermixing relation to the first grade of molten steel for preventing the entrapment of gas bubbles about the separator device and for reducing the tendency of splattering of the second grade of molten steel when directed into the mold and onto the grade separator device.

10. In the continuous casting system of claim 9 in which said parallel separator plates are secured together by transversely extending tie-rods.

11. In the continuous casting system of claim 9 in which said grade separator device includes a pair of support plates secured in upstanding relation to said separator plates for facilitating handling and positioning of the grade separator device into said mold.

12. In the continuous casting system of claim 9 in which said grade separator device has an overall width corresponding substantially to the width of the mold opening.

13. In a continuous metal casting system comprising a mold having an inlet opening into which molten metal of different grades may be selectively directed and a discharge end from which at least a partially solidified casting continuously emerges, means for selectively directing successive different grades of metal into the mold, a grade separator device for positioning into the mold inlet opening immediately following completion of the introduction of a first grade of molten metal into the mold and before the introduction of a second grade for forming a separating barrier between the first and second grades of molten metal and for enhancing cooling and solidification at the juncture between said first and second grades of molten metal, and said grade separator device having a discontinuous V-shaped construction that extends substantially the length of said mold opening and spans an overall width corresponding substantially to the width of the mold opening for permitting limited flow of the second grade of molten metal through the separator device for intermixing with the first grade of molten metal.

14. In a continuous metal casting system comprising a mold having an inlet opening into which molten metal of different grades may be selectively directed and a discharge end from which at least a partially solidified casting continuously emerges, means for selectively directing successive different grades of metal into the mold, a grade separator device for positioning into the mold inlet opening immediately following completion of the introduction of a first grade of molten metal into the mold and before the introduction of a second grade for forming a separating barrier between the first and second grades of molten metal and for enhancing cooling and solidification at the juncture between said first and second grades of molten metal, and said grade separator device including a pair of separator plates disposed in a V-shaped configuration with a downstream apex end thereof separated by a predetermined spacing and which extend substantially the length of said mold opening and together span an overall width corresponding substantially to the width of the mold opening.

15. In the continuous casting system of claim 14 in which said spacing between said plates has a lateral width of about ¼ inch.

16. In a continuous steel casting system comprising a mold having an inlet opening into which molten steel of different grades may be selectively directed and a discharge end from which at least a partially solidified casting continuously emerges, means for selectively directing successive different grades of steel into the mold, a grade separator device for positioning into the mold inlet opening immediately following completion of the introduction of a first grade of molten steel into the mold and before the introduction of a second grade for forming a separating barrier between the first and second grades of molten steel and for enhancing cooling and solidification at the juncture between said first and second grades of molten steel, and said grade separator device comprising a plurality of spaced apart separator plates mounted in a V configuration which extend substantially the length of the mold opening and which together span an overall width corresponding substantially to the width of the mold opening so as to define a discontinuous construction that permits the limited flow of the second grade molten steel through the grade separator device into intermixing relation to the first grade of molten steel for preventing the entrapment of gas bubbles about the separator device and for reducing the tendency of splattering of the second grade of molten steel when directed into the mold and onto the grade separator device.

17. In a method of continuously casting different grades of metal in a mold comprising the steps of introducing one grade of molten metal into the mold for forming a continuous casting, positioning a separator medium having a discontinuous V-shaped construction into the mold immediately following completion of the introduction of said first grade of molten metal into the mold and before the introduction of a second grade of molten metal for forming a separating barrier between the first and a subsequent introduction of a second grade of molten metal and for enhancing cooling and solidification at the juncture between said first and second grades of molten metal, and then introducing the second grade of molten metal into the mold on top of the separator medium while permitting limited flow of the second grade of molten metal through the separator medium and into limited intermixing relation with the first grade of molten metal for preventing the entrapment of gas bubbles about the separator medium and for reducing the tendency for splattering of the second grade of molten metal introduced into the mold and onto the separator medium.

18. The method of claim 17 including positioning of said separator medium into the mold by positioning a plurality of longitudinally extending spaced apart metal separator plates directly into contact with the last of the first grade of molten metal introduced into the mold.

19. In the method of claim 17 including placing said separator medium into said mold by suspending said medium from a pair of vertical support plates.

20. The method of claim 19 including suspending said separator medium by means of a common pole removably positioned in pole receiving slots in said medium.

21. The method of claim 20 including positioning said separator medium into said mold and then removing said pole from said separator medium.

22. In a method of continuously casting different grades of metal in a mold comprising the steps of introducing a first grade of molten metal into the mold for forming a continuous casting, immediately following completion of the introduction of said first grade of molten metal into the mold and before the introduction of a second grade of molten metal positioning a separating medium into the mold in the form of metal separator plates disposed in a V-shaped configuration with a spacing at a downstream apex end thereof for forming a separating barrier between the first and second grades of molten metal and for enhancing cooling and solidification at the juncture between said first and second grades of molten metal, and then introducing the second grade of molten metal into the mold on top of the separating medium while permitting limited flow of the second grade of molten metal through the spacing between said separator plates into intermixing relation with the first grade of molten metal for preventing the entrapment of gas bubbles about the separator medium and for reducing the tendency for splattering of the second grade of molten metal introduced into the mold and onto the separator medium.

* * * * *